US007647898B2

(12) United States Patent
Yoshinari et al.

(10) Patent No.: US 7,647,898 B2
(45) Date of Patent: Jan. 19, 2010

(54) BOILER AND LOW-NOX COMBUSTION METHOD

(75) Inventors: Yuji Yoshinari, Matsuyama (JP); Osamu Tanaka, Matsuyama (JP); Yukihiro Tokunaga, Matsuyama (JP)

(73) Assignee: Miura Co., Ltd., Matsuyama-shi, Ehime-ken (JP)

( * ) Notice: Subject to any disclaimer, the term of this patent is extended or adjusted under 35 U.S.C. 154(b) by 355 days.

(21) Appl. No.: 11/349,932

(22) Filed: Feb. 9, 2006

(65) Prior Publication Data

US 2006/0177784 A1 Aug. 10, 2006

(30) Foreign Application Priority Data

Feb. 10, 2005 (JP) ..... 2005-035028

(51) Int. Cl.
*F23C 5/00* (2006.01)

(52) U.S. Cl. ..... 122/235.13; 122/18.4; 431/8

(58) Field of Classification Search ..... 122/235.11, 122/235.13, 235.23, 367.3, 18.4; 431/8, 431/5, 7, 10
See application file for complete search history.

(56) References Cited

U.S. PATENT DOCUMENTS 4,395,223 A * 7/1983 Okigami et al. ..... 431/10
4,825,813 A * 5/1989 Yoshinari et al. ..... 122/6 A
5,020,479 A * 6/1991 Suesada et al. ..... 122/235.11
5,201,650 A * 4/1993 Johnson ..... 431/9
5,353,748 A * 10/1994 Kayahara et al. ..... 122/18.4
5,441,103 A * 8/1995 Rezkallah et al. ..... 165/104.29
5,441,403 A * 8/1995 Tanaka et al. ..... 431/175
5,584,684 A * 12/1996 Dobbeling et al. ..... 431/285
6,116,196 A 9/2000 Watanabe et al.
6,595,003 B2 * 7/2003 Dalla Betta et al. ..... 60/777
6,638,061 B1 * 10/2003 Cain et al. ..... 432/14
6,652,265 B2 * 11/2003 Cain ..... 431/6
6,663,380 B2 * 12/2003 Rabovitser et al. ..... 431/9
6,875,009 B2 * 4/2005 Kayahara et al. ..... 431/9
2004/0072110 A1 * 4/2004 Kayahara et al. ..... 431/5

FOREIGN PATENT DOCUMENTS

JP 6-159612 A 6/1994
JP 3221582 B2 8/2001

* cited by examiner

*Primary Examiner*—Gregory A Wilson
(74) *Attorney, Agent, or Firm*—Birch, Stewart, Kolasch & Birch, LLP

(57) ABSTRACT

To provide a boiler capable of realizing a reduction in $O_2$, a reduction in NOx, and a reduction in CO. The present invention provides a boiler including: a premixed gas burner, and water tubes in close proximity to the premixed gas burner, characterized in that the premixed gas burner ejects a premixed gas toward the water tubes at a predetermined angle; and the boiler further includes a fuel supply portion capable of supplying at least one of a gas fuel and a premixed gas provided at a position on a downstream side of and spaced apart by a predetermined distance from the premixed gas burner.

10 Claims, 4 Drawing Sheets

BOILER AND LOW-NOX COMBUSTION METHOD

BACKGROUND OF THE INVENTION

1. Field of the Invention

The present invention relates to a boiler and a low-NOx combustion method.

2. Description of the Related Art

Environmental pollution has long been a serious societal issue, and, also in boilers, there is a demand for a reduction in harmful substances (NOx, CO, soot, etc.). Various harmful substance reducing techniques for boilers have been proposed. For example, a technique is known according to which a cooling member is installed on the downstream side and in the immediate vicinity of the burner (See JP 06-159612 A).

Further, nowadays, in addition to the request to solve environmental pollution, there is a demand for energy saving, etc., and a further reduction in harmful substances is required. That is, to achieve a solution to the problem of environmental pollution and energy saving, there is a demand for a technique to achieve a reduction in harmful substances at a higher level.

More specifically, for energy saving, there is a demand for a boiler capable of realizing a reduction in $O_2$, that is, a reduction in residual oxygen amount in exhaust gas (e.g., a residual oxygen amount of 3% in exhaust gas), a reduction in NOx (e.g., 20 ppm or less), and a reduction in CO (e.g., 50 ppm or less). However, with the conventional techniques, it is rather difficult to realize such a boiler.

SUMMARY OF THE INVENTION

The present invention has been made with a view toward solving the above problem in the prior art. An object of the present invention is, therefore, to provide a boiler capable of realizing a reduction in $O_2$, a reduction in NOx, and a reduction in CO. Another object of the present invention is to provide a low-NOx combustion method which helps to achieve a reduction in $O_2$, a reduction in NOx, and a reduction in CO.

According to the present invention, which has been made with a view toward achieving the above objects, there is provided a boiler including a premixed gas burner, and water tubes in close proximity to the premixed gas burner, is characterized in that the premixed gas burner ejects a premixed gas toward the water tubes at a predetermined angle, and the boiler further includes a fuel supply portion capable of supplying at least one of a gas fuel and a premixed gas provided at a position on a downstream side of and spaced apart by a predetermined distance from the premixed gas burner.

Further, a combustion device according to the present invention preferably has a structure including a combustion reaction promoting region for promoting combustion reaction provided on the downstream side of the fuel supply portion.

Further, a combustion device according to the present invention preferably has a structure in which the premixed gas ejected from the premixed gas burner has air ratio which satisfies the following relational expression:

$$1.3 \leqq \text{air ratio} \leqq 2.0.$$

Further, a combustion device according to the present invention preferably has a structure in which the fuel supply portion supplies at least one of a gas fuel and a premixed gas to a portion where the gas temperature is within a range as expressed by the following relational expression:

$$800^\circ\ \text{C.} \leqq \text{gas temperature} \leqq 1200\text{C.}^\circ.$$

Moreover, according to the present invention, which has been made with a view toward achieving the above objects, there is provided a low-NOx combustion method for reducing NOx through multi-stage fuel supply, characterized by including a first fuel supply step for supplying a premixed gas at a position in close proximity to a cooling member, and a second fuel supply step for supplying at least one of a gas fuel and a premixed gas after the first fuel supply step.

Further, a low-NOx combustion method according to the present invention preferably has a structure including a combustion reaction promoting step for promoting combustion reaction performed after the second fuel supply step.

Further, a low-NOx combustion method according to the present invention preferably has a structure in which, in the first fuel supply step, the premixed gas has air ratio which satisfies a relationship as expressed by the following relational expression:

$$1.3 \leqq \text{air ratio} \leqq 2.0.$$

Further, a low-NOx combustion method according to the present invention preferably has a structure in which, in the second fuel supply step, at least one of the gas fuel and the premixed gas is supplied to a portion where the gas temperature is within a range as expressed by the following relational expression:

$$800^\circ\ \text{C.} \leqq \text{gas temperature} \leqq 1200\text{C.}^\circ.$$

Moreover, the present invention has been made with a view toward achieving the above objects, and provides a low-NOx combustion method for reducing NOx through multi-stage fuel supply, characterized by including a main fuel supply step for supplying a premixed gas at a position in close proximity to a cooling member, and an additional fuel supply step for supplying at least one of a gas fuel and a premixed gas after the main fuel supply step so that gas temperature is equal to or lower than an NOx generation limit even if fuel is supplied. The additional fuel supply step may be conducted a plurality of times.

Further, the present invention has been made with a view toward achieving the above objects, and provides a boiler equipped with a boiler body having a water tube group arranged in an annular fashion, and a premixed gas burner provided at the center of the water tube group, characterized in that a premixed gas is ejected from the premixed gas burner at a predetermined angle with respect to the inner peripheral surface of the water tube group, and there is provided, at a position on the downstream side of and spaced apart from the premixed gas burner by a predetermined distance, a fuel supply portion capable of supplying at least one of a gas fuel and a premixed gas.

Further, the present invention provides a boiler equipped with a boiler body having a water tube group arranged in an annular fashion, and a premixed gas burner provided at the center of the water tube group, characterized in that there are provided a plurality of water tube groups, a gas flow passage (an inner opening) communicating with the inner peripheral surface of an outer water tube group is formed in a part of an inner water tube group, a premixed gas is ejected from the premixed gas burner at a predetermined angle with respect to the inner peripheral surface of the inner water tube group, after a gas flow along the axial direction of the inner water tube group is formed, there is formed a gas flow along an annular gas flow passage between the inner water tube group and the outer water tube group through the gas flow passage (inner opening), and there is provided, at a position on the downstream side of and spaced apart from the premixed gas burner by a predetermined distance (e.g., on the downstream side of the inner opening), a fuel supply portion capable of supplying at least one of a gas fuel and a premixed gas.

According to the present invention, it is possible to provide a boiler capable of realizing a reduction in $O_2$, a reduction in NOx, and a reduction in CO. Further, according to the present invention, it is possible to provide a low-NOx combustion method which helps to realize a reduction in $O_2$, a reduction in NOx, and a reduction in CO.

Before describing the embodiments of the present invention, some of the terms as used in the present specification will be defined.

In the present specification, the term "gas", when simply so referred to, means a concept which covers at least one of a gas undergoing combustion reaction and a gas which has undergone combustion reaction; it may also be referred to as a combustion gas. That is, "gas" is a concept that covers all of the following cases: a case in which there exist both a gas undergoing combustion reaction and a gas that has undergone combustion reaction, a case in which only a gas undergoing combustion reaction exists, and a case in which only a gas that has undergone combustion reaction exists. This applies to the following description unless otherwise specified.

Further, unless otherwise specified, gas temperature is the temperature of a gas during combustion reaction, and is of the same meaning as combustion temperature or combustion flame temperature. Further, suppression of gas temperature means keeping the maximum value of gas (combustion flame) temperature at a low level. Normally, even in a "gas that has undergone combustion reaction" as mentioned above, combustion reaction continues in a minute amount, so that the expression "completion of combustion reaction" does not mean completion by 100% of combustion reaction.

In the following, some embodiments of the present invention will be described.

A boiler according to a first embodiment of the present invention is a boiler equipped with a premixed gas burner, and water tubes (or a water tube group) in close proximity to the premixed gas burner, in which a premixed gas is ejected from the premixed gas burner at a predetermined angle with respect to the water tubes (or the water tube group), and there is provided, at a position on the downstream side of and spaced apart from the premixed gas burner by a predetermined distance, a fuel supply portion capable of supplying at least one of a gas fuel and a premixed gas.

Here, the term "predetermined angle" is a concept that covers not only the case in which the direction in which the premixed gas is ejected and the axial direction (the longitudinal direction) of the water tubes (the water tube group) are vertical, but also the case in which they are somewhat inclined from the vertical direction (This also applies to the following description unless otherwise specified). For example, it covers the case in which the direction in which the premixed gas is ejected and the axial direction of the water tubes (the water tube group) are inclined by approximately 30 degrees from the vertical direction. In the first embodiment of the present invention, it is desirable to adopt a construction in which the direction in which the premixed gas is ejected and the axial direction of the water tubes (the water tube group) are inclined from the vertical direction by 15 degrees or less. More preferably, the premixed gas is ejected from the premixed gas burner perpendicularly to the water tubes (the water tube group).

With this construction, gas is ejected from the premixed gas burner toward the water tubes (the water tube group) in close proximity to the premixed gas burner, so the gas temperature is suppressed by the water tubes (the water tube group), thereby achieving a reduction in NOx.

Further, in the boiler according to the first embodiment of the present invention, there is provided, at a position on the downstream side of and spaced apart from the premixed gas burner by a predetermined distance, a fuel supply portion capable of supplying at least one of a gas fuel and a premixed gas, so some percentage of the requisite fuel is supplied into the boiler from this fuel supply portion. That is, a multi-stage fuel combustion is effected by using the premixed gas burner and the fuel supply portion. Thus, in the boiler according to the first embodiment of the present invention, it is possible to achieve a reduction in NOx based on multi-stage fuel combustion (through execution of high air-ratio combustion and low air-ratio combustion).

As the premixed gas burner constituting the boiler according to the first embodiment of the present invention, there is used, for example, a burner which is flat and in which premixed gas ejection holes are formed in substantially the same plane. For example, there is used a premixed gas burner in which corrugated plates and flat plates are alternately stacked together to form a large number of premixed gas ejection holes. However, the premixed gas burner according to this embodiment is not restricted to this construction. While a burner in which the premixed gas ejection holes are formed substantially in the same plane is preferable, it is also possible to adopt any type of construction. Thus, the premixed gas burner according to this embodiment may be formed by a ceramic plate having a large number of ejection holes through which premixed gas is ejected.

Further, the boiler according to the first embodiment of the present invention is equipped with a boiler body formed by using a large number of heat absorbing water tubes (heat transfer tubes), and as stated above, the premixed gas burner is provided in close proximity to the water tubes (the water tube group) constituting this boiler body. This boiler body is equipped with an upper header and a lower header, and is formed by arranging upright a plurality of water tubes between the upper and lower headers. The boiler body constituting the boiler according to the first embodiment of the present invention is formed as a so-called "square type boiler body" in which a large number of water tubes provided between the upper and lower headers are arranged at predetermined intervals inside a substantially rectangular gas flow space. The premixed gas burner is provided in close proximity to one side surface of this square type boiler body.

In the boiler according to the first embodiment of the present invention, constructed as described above, the NOx value at the first stage (the premixed gas burner) is reduced as far as possible through gas temperature suppression by the water tubes provided in close proximity and multi-stage combustion, and, to continuously maintain that NOx value (low NOx value) to the final stage, there is provided, at an appropriate position, a fuel supply portion for the second stage of the multi-stage combustion. That is, in the boiler according to the first embodiment of the present invention, a reduction in NOx is realized through gas cooling and fuel supply to an appropriate gas temperature zone.

Next, a boiler according to a second embodiment of the present invention has, in addition to the boiler construction of the first embodiment of the present invention, a combustion reaction promoting region for promoting combustion reaction on the downstream side of the fuel supply portion. In other words, the boiler according to the second embodiment of the present invention has an oxidation promoting region for promoting oxidation by causing gas to stay for a predetermined period of time.

In this construction, due to the provision of the combustion reaction promoting region, it is possible to positively oxidize the CO in the gas that has not been completely oxidized through promotion of cooling and multi-stage fuel combustion. Thus, in the boiler according to the second embodiment of the present invention, it is possible to continue a combustion state not attaining the NO generating temperature and to promote oxidative combustion of the unburned substances and CO, thereby realizing a reduction in CO in addition to a reduction in NOx.

Further, in the boilers according to the first and second embodiments of the present invention described above, it is possible for the water tubes situated in the vicinity of the fuel supply portion or on the downstream side of the fuel supply portion to be equipped with a fin, stud, etc. (hereinafter referred to as "fin or the like"). By thus equipping the water tubes situated in the vicinity of the fuel supply portion with a fin or the like, the fin or the like constitutes a flame holding portion, so it is possible to attain a stable combustion state and to promote heat transfer and gas cooling. Also when the water tubes situated on the downstream side of the fuel supply portion is equipped with a fin or the like, heat transfer and gas cooling are promoted.

Next, in a boiler according to a third embodiment of the present invention, in the construction of the first or second embodiment of the present invention described above, the air ratio of the premixed gas ejected from the premixed gas burner satisfies the following relationship:

$$1.3 \leqq \text{air ratio} \leqq 2.0.$$

With this arrangement, it is possible to obtain a boiler capable of achieving a low NOx value as required (20 ppm or less). Generally speaking, an increase in air ratio results in a reduction in NOx value. Thus, in the boiler according to this embodiment, it is desirable for the air ratio in the premixed gas burner to be higher. However, when the air ratio is too high, the flame holding in the premixed gas burner becomes rather difficult, and there is a fear of "blow-off" occurring. Taking into account the "blow-off" limit, it is desirable for the air ratio in the premixed gas burner to be 2.0 or less. Further, to ensure a more satisfactory flame holding property in the premixed gas burner, it is desirable for the air ratio to be 1.6 or less.

As stated above, it is desirable for the air ratio in the premixed gas burner according to this embodiment to be 1.3 or more. Generally speaking, an increase in air ratio results in a reduction in NOx value, and conversely, a reduction in air ratio results in an increase in NOx value. In the boiler according to this embodiment, the NOx value in the premixed gas burner (combustion means at the first stage of multi-stage combustion) is reduced as far as possible, and, to continuously maintain that NOx value (the low NOx value) to the final stage (a chimney portion for discharging the exhaust gas to the exterior of the boiler), there is provided, at an appropriate position, a fuel supply portion for from the second stage of multi-stage combustion onward. That is, in this embodiment, the NOx value at the first stage (the premixed gas burner) is important, and the NOx value of this premixed gas burner must be not more than the low NOx value as required (not more than 20 ppm). Thus, to attain a combustion state with an NOx value not more than the low NOx value as required, it is desirable for the air ratio of the premixed gas burner of this embodiment to be 1.3 or more.

Next, in a boiler according to a fourth embodiment of the present invention, in one of the constructions of the first through third embodiments of the present invention, at least one of a gas fuel or a premixed gas is supplied from the fuel supply portion to a portion where the gas temperature is within the range of the following relational expression:

$$800^\circ\ \text{C.} \leqq \text{gas temperature} \leqq 1200\text{C.}^\circ.$$

In other words, in the boiler of this embodiment, the fuel supply portion is provided such that, if at least one of a gas fuel or a premixed gas is supplied, the gas temperature only rises to approximately 1300C°. That is, taking into account the relationship between the heat generation due to the unburned gas from the premixed gas burner, the heat generation due to the fuel additionally supplied from the fuel supply portion, and the cooling by the water tubes, the boiler of this embodiment is constructed such that, even if a gas fuel or the like is supplied, at least one of a gas fuel and a premixed gas is supplied from the fuel supply portion so that the gas temperature may be not higher than the NOx generation limit (not higher than 1300C°). More specifically, a gas fuel or the like is supplied to a portion where the gas temperature is not higher than 1200C°, and the NOx value generated by the premixed gas burner is prevented from rising, whereby it is possible to maintain the combustion state, so it is possible to obtain a boiler capable of attaining a low NOx value as required (20 ppm or less).

In the boiler of this embodiment, no particular ignition device is provided in the fuel supply portion. Thus, it is desirable for the portion to which at least one of a gas fuel and a premixed gas is supplied from the fuel supply portion to be at a temperature at which the gas fuel, etc. can undergo self-combustion. Thus, it is desirable for the gas temperature of the portion to which the gas fuel or the like is supplied from the fuel supply portion to be 800C.° or more. However, the present invention does not exclude a construction in which an ignition device is provided, and it is possible to provide an ignition device in the fuel supply portion or in the vicinity thereof as needed. When a construction in which an ignition device is thus provided is adopted, there is no need for the gas temperature of the portion to which the gas fuel or the like is supplied from the fuel supply portion to be 800C.° or more; it may be not higher than the temperature allowing self-combustion.

Further, as stated above, in the boiler of this embodiment, the NOx value in the combustion means at the first stage of multi-stage combustion (the premixed gas burner) is reduced as far as possible, and, to continuously maintain that NOx value (the low NOx value) to the final stage (a chimney portion for discharging the exhaust gas to the exterior of the boiler), there is provided, at an appropriate position, a fuel supply portion for the second stage of multi-stage combustion. However, the present invention is not restricted to the "two-stage" combustion, but allows adoption of a "multi-stage" combustion of three stages or more as needed. That is, the NOx value in the premixed gas burner is reduced as far as possible, and, to continuously maintain that NOx value to the final stage (the chimney portion), there may be provided, at appropriate positions, a fuel supply portion for the second stage, a fuel supply portion for a third stage, and a fuel supply portion for a fourth stage. Of course, it is also possible to restrict the stages to the third one or to provide a fifth stage onward. With this construction, it is possible to obtain a boiler capable of realizing a reduction in $O_2$, a reduction in NOx, and a reduction in CO by selecting a more effective number of stages according to the combustion amount of the boiler, the size of the boiler body, etc.

Further, in the boilers of the first through fourth embodiments of the present invention, it is desirable to provide, on the water tube group situated in close proximity to the burner to suppress the gas temperature, a fin extending from the cooling surface of each water tube in contact with high-speed flowing gas perpendicularly to the gas flowing direction. Preferably, this fin is formed as a stud-like member, has a small projection area so that the flow resistance of the high-speed flow may not increase, and has a sufficient contact surface at the base portion of the cooling surface; it is formed as a cylinder, an elliptical cylinder, a cone or the like having a height to the forward end of approximately 50 mm or less, using a material whose forward end temperature does not exceed the heat resistant temperature of the material. In the boiler thus constructed, it is possible to effectively cool a maximum gas (flame) temperature zone formed in a very thin boundary layer of zero speed around the water tubes, making it possible to achieve a substantial reduction in exhaust NOx value.

A low-NOx combustion method according to a fifth embodiment of the present invention is a low-NOx combustion method in which a reduction in NOx is achieved by supplying a fuel in a multi-stage fashion, the method including: a first fuel supply step for supplying a premixed gas at a position in close proximity to a cooling member (e.g., the water tubes or the water tube group constituting the boiler), and a second fuel supply step for supplying at least one of a gas fuel and a premixed gas after the first fuel supply step.

With this arrangement, it is possible to cool the gas in the first fuel supply step to suppress the gas temperature, so that it is possible to achieve a reduction in NOx. Further, due to the provision of the first fuel supply step and the second fuel supply step, it is possible to conduct multi-stage fuel combustion, so that it is possible to achieve a reduction in NOx through multi-stage combustion (through execution of high air-ratio combustion and low air-ratio combustion).

In a low-NOx combustion method according to a sixth embodiment of the present invention, a combustion reaction promoting step for promoting combustion reaction is conducted after the second fuel supply step.

With this arrangement, due to the provision of the combustion reaction promoting step, it is possible to promote cooling and to positively oxidize the CO in the gas that has not been completely oxidized through multi-stage fuel combustion. That is, with this arrangement, it is possible to continue a combustion state not attaining the NO generating temperature, and to promote oxidative combustion of unburned substances and CO, thereby making it possible to realize a reduction in CO in addition to a reduction in NOx.

Next, in a low-NOx combustion method according to a seventh embodiment of the present invention, in the first fuel supply step constituting the methods of the fifth and sixth embodiments of the present invention, the air ratio of the premixed gas satisfies the following relationship:

$$1.3 \leqq \text{air ratio} \leqq 2.0.$$

With this arrangement, it is possible to obtain a low-NOx combustion method making it possible to attain a low NOx value as required (20 ppm or less) while maintaining a stable combustion state free from "blow-off" in the first stage (the first fuel supply step) of the multi-stage combustion. In this low NOx combustion method, to ensure a satisfactory combustion state (flame holding property) in the first fuel supply step, it is desirable for the air ratio to be 1.6 or less.

Next, in a low-NOx combustion method according to an eighth embodiment of the present invention, in the fifth embodiment of the present invention, in the sixth embodiment of the present invention, or in the second fuel supply step constituting the method of the sixth embodiment of the present invention, even if at least one of a gas fuel and a premixed gas is supplied to a gas within the gas temperature range as defined below, at least one of the gas fuel and the premixed gas is supplied to a portion where the gas temperature is within the temperature range as expressed by the following relational expression so that the gas temperature after the supply of the gas fuel, etc. may be not higher than the NOx generation limit (1300C.° or less):

$$800^\circ\ \text{C.} \leqq \text{gas temperature} \leqq 1200\text{C.}^\circ.$$

That is, in the eighth embodiment of the present invention, even after the supply of the gas fuel or the like, the gas fuel or the like is supplied to a portion where the gas temperature is not higher than the NOx generation limit. Thus, with this arrangement, it is possible to maintain the combustion state without involving any increase in the NOx value generated in the first fuel supply step, so it is possible to obtain a low-NOx combustion method making it possible to attain a low NOx value as required (20 ppm or less). Further, in this combustion method, a gas fuel or the like is supplied to a gas at a temperature of not lower than 800° C., and at such a temperature, the gas fuel or the like supplied at the time of the second fuel supply step undergoes self-combustion. Thus, with this arrangement, it is possible to obtain a low-NOx combustion method not requiring any ignition step (ignition device) in the second fuel supply step.

Next, according to a ninth embodiment of the present invention, there is provided a low-NOx combustion method in which a reduction in NOx is achieved through multi-stage fuel supply, the method including: a main fuel supply step for supplying a premixed gas at a position in close proximity to a cooling member, and an additional fuel supply step for supplying at least one of a gas fuel and a premixed gas so that the gas temperature may be not higher than the NOx generation limit even if the fuel is supplied after the main fuel supply step. The additional fuel supply step may be conducted a plurality of times.

Next, specific examples of the present invention will be described. It should be noted that the present invention is not restricted to the above-described embodiments or the following examples; appropriate modifications are naturally possible without departing from the gist of the invention, all of such modifications being covered by the technical scope of the present invention.

DETAILED DESCRIPTION OF THE PREFERRED EMBODIMENTS

In the following, specific examples of the boiler and the low-NOx combustion method according to the present invention will be described with reference to the drawings.

Figure 1:
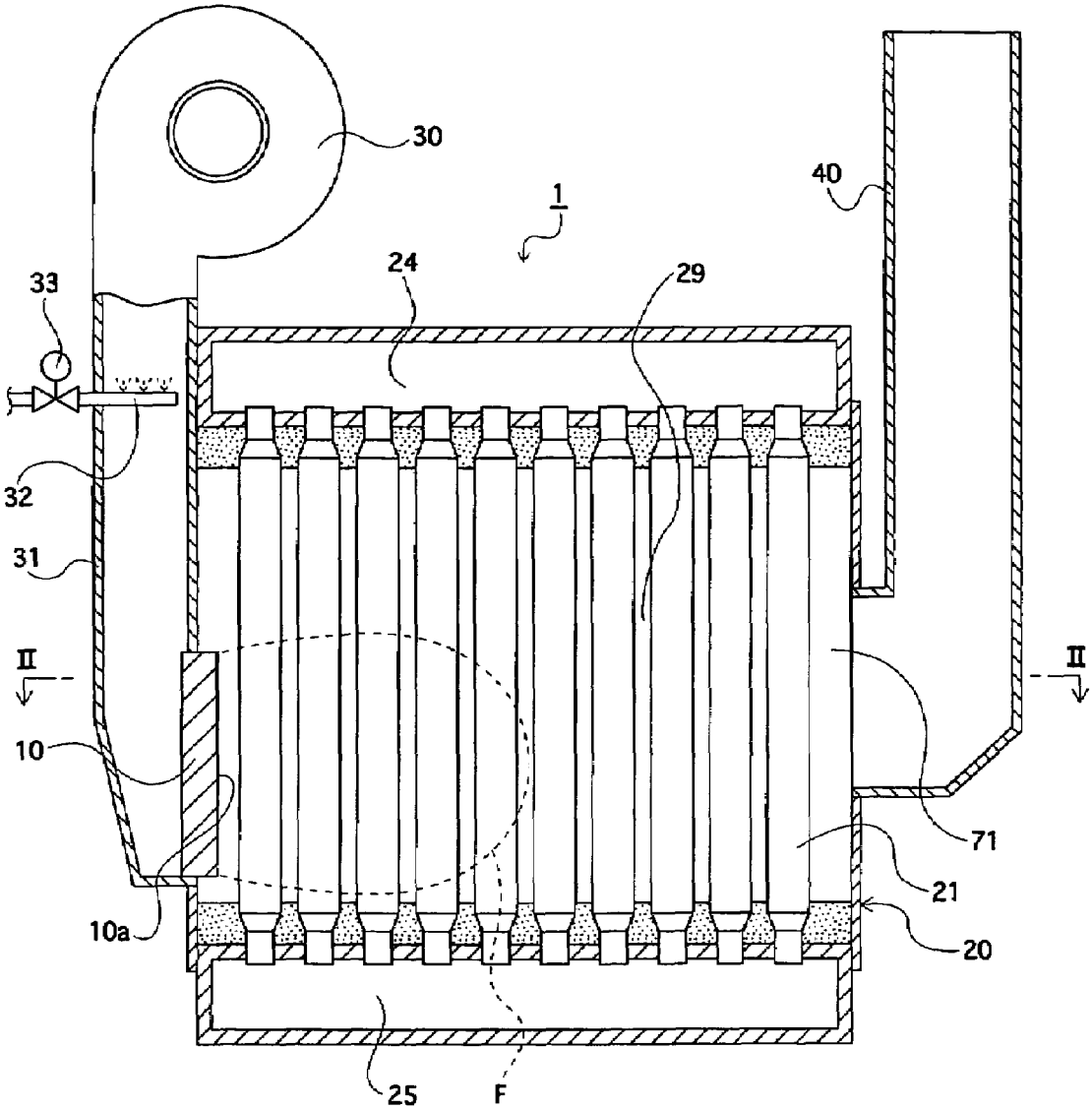
FIG. 1 is an explanatory longitudinal sectional view of an example of a steam boiler according to the present invention.
Figure 2:
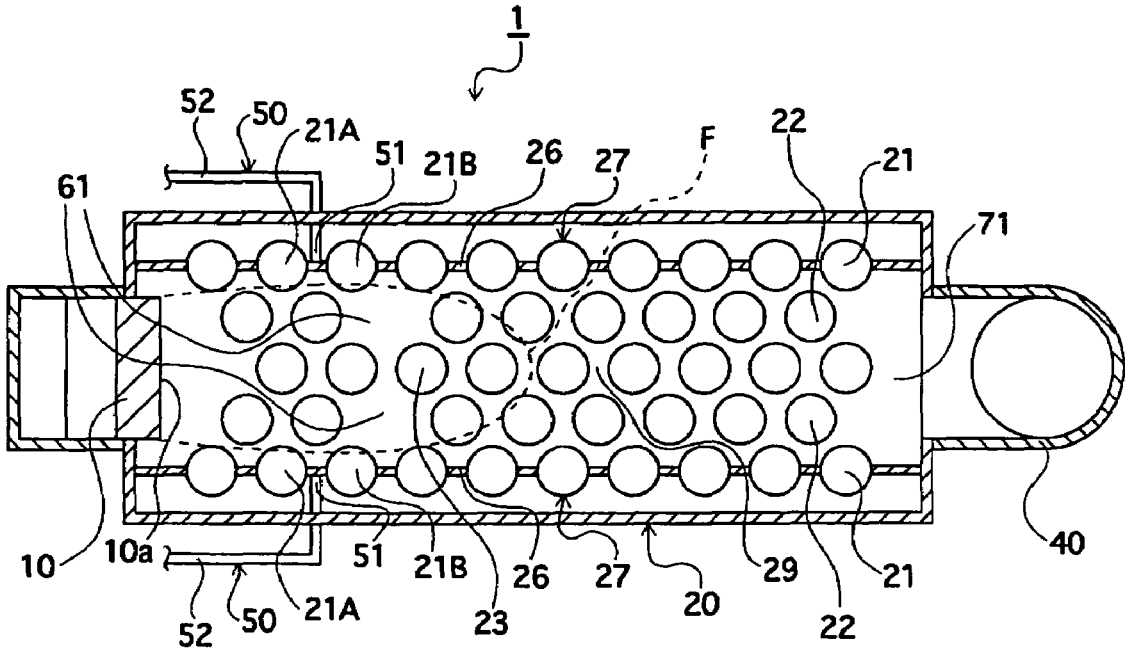
FIG. 2 is an explanatory cross-sectional view taken along a line II-II of FIG. 1.

FIG. 1 is an explanatory longitudinal sectional view of an example of a steam boiler according to the present invention. FIG. 2 is an explanatory cross-sectional view taken along the line II-II of FIG. 1.

As shown in FIGS. 1 and 2, a boiler 1 of this example is composed of a completely premixed type burner 10 (which corresponds the "premixed gas burner" of the present invention) having a planar premixed gas ejection surface (a flat combustion surface in which premixed gas ejection holes are formed substantially in the same plane), a boiler body 20 formed by using a large number of heat absorbing water tubes (heat transfer tubes) 21, 22, and 23 (which correspond to the "cooling member" of the present invention), a blower 30 provided in order to supply combustion air to the burner 10, a chimney portion 40 provided in order to discharge exhaust gas in the boiler body 20 to the exterior of the boiler 1, etc. In addition, in this example, there are provided fuel supply portions 50 at positions spaced apart from the burner 10 by a predetermined distance in the premixed gas ejecting direction (positions between water tubes 21A and 21B (see FIG. 2)).

The burner 10 constituting the boiler 1 of this example is a premixed gas burner in which premixed gas ejection holes are formed substantially in the same plane and which is formed by alternately stacking together corrugated plates and flat plates. Due to this construction, a large number of premixed gas ejection holes are formed in a premixed gas ejection surface (combustion surface) 10*a* of the burner 10. Further, the burner 10 is provided in close proximity to water tubes (water tube groups) constituting the boiler body 20 described below. Although a detailed description thereof is omitted here, the burner 10 of this example has a construction similar to that of the "combustion burner" as disclosed, for example, in JP 3221582 B.

The boiler body 20 constituting the boiler 1 of this example is composed of an upper header 24, a lower header 25, a plurality of water tubes (outer water tubes 21, inner water tubes 22, and central water tubes 23) arranged upright between the upper and lower headers 24 and 25, etc. In the boiler body 20, the outer water tubes 21, the inner water tubes 22, and the central water tubes 23 are arranged in the gas flowing direction (the longitudinal direction of the boiler body 20), and on either side of the central water tube group (the water tube group formed by the central water tubes 23), there are formed two rows of inner water tube groups (the water tube groups formed by the inner water tubes 22) and two rows of outer water tube groups (the water tube groups formed by the outer water tubes 21). The adjacent water tubes are arranged in a zigzag fashion. Further, as shown in FIG. 2, in the boiler body 20 of this example, a pair of water tube walls 27 are formed by using outer water tubes 21 provided on both sides in the longitudinal direction and connecting portions 26 connecting the outer water tubes 21 to each other. In the boiler body 20, there is formed a substantially rectangular gas flowing space 29 by using the pair of water tube walls 27 and the upper and lower headers 24 and 25, and in the gas flowing space 29, the inner water tubes 22 and the central water tubes 23 are arranged at predetermined intervals.

The blower 30 constituting the boiler 1 of this example is provided for the purpose of supplying air to the burner 10, and the blower 30 and the burner 10 are connected to each other by an air supply route portion 31. In the air supply route portion 31, there is provided a gas fuel supply tube 32, and the gas fuel supply tube 32 is provided with a fuel adjustment valve 33 for adjusting fuel flow rate between high combustion and low combustion. The air supply route portion 31 may be further equipped with a throttle portion for achieving an improvement in fuel/air mixing property as needed.

The chimney portion 40 constituting the boiler 1 of this example has its inlet provided on the most downstream side of the boiler body 20 so as to be opposed to the burner 10. Thus, in the boiler 1 of this example, the gas generated by the burner 10 is brought into linear contact with the water tubes 21, 22, and 23 constituting the boiler body 20 (undergoes heat exchange through contact), and then discharged to the exterior of the boiler 1 through the chimney portion 40 as exhaust gas.

The fuel supply portions 50 constituting the boiler 1 of this example are composed of fuel ejecting portions 51 each provided between two adjacent outer water tubes 21A and 21B, and fuel supply piping 52 for supplying gas fuel to the fuel ejecting portions 51. While in this example gas fuel is ejected from the fuel ejecting portions 51 constituting the fuel supply portions 50, the present invention is not restricted to this construction; it is also possible to eject a premixed gas previously mixed with air through the fuel ejecting portions 51, as needed. Although it is omitted here, the fuel supply piping 52 is equipped with a fuel adjustment valve for adjusting the flow rate of the gas fuel (or of the premixed gas).

The boiler 1 of this example is thus constructed. Inside the boiler 1 of this example, constructed as described above, the following combustion state is attained.

First, the gas fuel supplied from the gas fuel supply tube 32 and the air supplied from the blower 30 are mixed with each other in the air supply route portion 31, and the premixed gas thus obtained by mixing is supplied to the burner 10. Here, from the gas fuel supply tube 32, gas fuel in an amount corresponding to 80% of the requisite combustion amount in the boiler 1 is supplied. The adjustment of the supply amount of gas fuel is effected by the fuel adjustment valve 33. Air is supplied from the blower 30 so as to attain an air ratio of approximately 1.4 to 1.5.

The premixed gas ejected from the premixed gas ejection surface 10*a* of the burner 10 is ignited by an ignition device (not shown), and there is formed by the burner 10 a gas F undergoing combustion reaction accompanied by a flame. The premixed gas is ejected from the burner 10 so as to be substantially perpendicular (orthogonal) to the water tubes 21, 22, and 23 in the boiler body 20, so the gas F undergoing combustion reaction is repeatedly brought into contact with the water tubes 21, 22, and 23 so as to cross the same (to effect heat exchange with the water tubes) before becoming exhaust gas. Then, the exhaust gas is discharged to the exterior of the boiler 1 through the chimney portion 40 provided on the most downstream side of the boiler body 20.

In this example, gas fuel in an amount corresponding to 20% of the requisite combustion amount in the boiler 1 is supplied from the fuel ejecting portions 51, which are provided between the outer water tubes 21A and 21B. The positions at which the fuel ejecting portions 51 are provided are positions where the gas temperature within the boiler body 20 is around 1000° C. Here, the remaining gas fuel is supplied, thereby making it possible to effect a multi-stage fuel combustion to attain the requisite combustion amount for the boiler 1.

A first region 61 provided between the central water tube group and the outer water tube group on the downstream side of the fuel supply portions 50 corresponds to a combustion reaction promoting region according to the present invention. That is, through the provision of the first region 61, the oxidation of the CO in the gas is promoted. Further, a second region 71 on the most downstream side of the boiler body 20 can also function as a combustion reaction promoting region according to the present invention. Although not shown in particular here, at least one of the first region 61 and the second region 71 may be provided with a CO oxidation catalytic substance in order to further promote the combustion reaction.

The water in the water tubes 21, 22, and 23 is turned into steam through heating by heat exchange with the gas ejected from the burner 10. This steam is supplied to equipment using steam (not shown) through a steam extracting device (not shown) connected to the upper header 24.

The boiler 1 of this example, in which the above-described combustion state is attained, can provide the following effects.

First, according to this example, gas fuel in an amount corresponding to 80% of the requisite combustion amount for the boiler 1 is supplied from the burner 10, and gas fuel in an amount corresponding to the remaining 20% is supplied from the fuel supply portions 50. In the burner 10, combustion is effected at an air ratio of approximately 1.4 to 1.5.

That is, in the burner 10, combustion is effected at a high air ratio, so the gas temperature is prevented from increasing, and the NOx value is suppressed. In addition, the burner 10 is provided in close proximity to the water tubes. Thus, through contact with the water tubes, the gas temperature is further prevented from increasing, and a further reduction in NOx is achieved.

Further, the fuel ejecting portions 51 are provided at positions where the gas temperature within the boiler body 20 is around 1000° C. Those positions are positions at which, even when the remaining gas fuel is supplied, and the fuel corresponding to the remaining 20% is burned together with the unburned gas of the burner 10, the gas temperature is suppressed to a level of approximately 1300° C. through the cooling action of the water tubes 21, 22, and 23. That is, the gas temperature is suppressed to a level not higher than the NOx generation limit. Thus, in this example, it is possible to form a boiler in which it is possible to obtain an exhaust gas whose NOx concentration is close to "0".

Further, in this example, there are provided combustion reaction promoting regions (the first region 61 and the second region 71), thereby making it possible to properly oxidize the CO in the gas that has undergone a reduction in NOx through gas temperature suppression. In this example, the combustion reaction promoting regions are provided on the downstream side of the fuel supply portions 50, and as stated above, the fuel supply portions 50 are provided at positions where the gas temperature is around 1000° C., with the gas temperature thereof being 1300° C. or less. Thus, with this construction, it is possible to form a region where NO has undergone no reaction and to exclusively oxidize (burn) the CO, thereby making it possible to achieve both a reduction in NOx and a reduction in CO.

Further, according to this example, by realizing the construction and the combustion state as described above, it is possible to achieve a reduction in NOx and a reduction in CO while keeping the remaining oxygen amount in the exhaust gas at the chimney portion 40 at a low level. More specifically, it is possible to set the NOx value (exhaust gas NOx corrected at 0% of $O_2$) to 1 ppm to 20 ppm (low NOx) and to set the CO value (read value) to 1 ppm to 50 ppm (low CO), with the remaining oxygen amount in the exhaust gas ranging from 0% to 3% (low $O_2$). That is, according to this example, it is possible to obtain a boiler capable of realizing a reduction in $O_2$, a reduction in NOx, and a reduction in CO.

Such low $O_2$ combustion leads not only to energy saving but also to a reduction in air amount and a reduction in the pressure loss of the boiler body. Thus, it also contributes to a reduction in the power of the blower and an improvement in the efficiency of the boiler body, thereby making it possible to achieve a reduction in boiler size (by approximately 10%).

One of the remarkable features of the present invention resides in that the premixed gas is supplied at high air ratio in the first fuel supply step (the main fuel supply step). According to the present invention, premixed combustion is adopted in the first fuel supply step instead of pre-mix type diffuse combustion, thereby achieving a remarkable effect. In the following, the effect will be described.

As in the above-described example, when fuel and air are mixed with each other at high air ratio (e.g., an air ratio of 1.5), the air-fuel mixing ratio is as high as 1:32 in the case, for example, of propane. If an attempt is made to realize high air ratio combustion through diffuse combustion, it is necessary to secure the combustibility in the flame holding plane (locally), so, even if there is a diluting effect due to air, NOx is likely to increase in the flame holding plane.

In the case of premixed combustion, in contrast, the fuel concentration distribution is fixed, so the temperature rise due to local combustion is suppressed, thereby making it possible to keep at a low level the NOx when high air ratio combustion is realized. In this case, however, CO is likely to increase (locally). In view of this, in the present invention, a combustion reaction promoting step is executed on the downstream side of the first fuel supply step to thereby also effect oxidation of CO. That is, through an overall construction, a reduction in NOx and a reduction in NO are realized.

When combustion is effected at high air ratio, the gas velocity is enhanced (for example, 40 m/s or more in the case of the above example), so, when diffuse combustion is adopted in the first fuel supply step, it is impossible to effectively realize a reduction in NOx and a reduction in CO from the second fuel supply step onward. That is, when diffuse combustion is adopted, there is involved a great variation in the gas component concentration distribution in the first fuel supply step (the distribution in a plane orthogonal to the gas flowing direction), and the influence thereof is likely to affect as it is the combustion reaction at the time of the second fuel supply step (the additional fuel supply step), resulting in an increase in NOx or CO. Further, due to the generation of such variation, it is difficult to properly determine the positions of the fuel supply portions 50, the fuel supply amount, etc.

In contrast, in the case of premixed combustion, the gas component concentration distribution in the first fuel supply step (the distribution in the plane orthogonal to the gas flowing direction) does not fluctuate so much but is substantially even, so it is possible to effectively realize a reduction in NOx and a reduction in CO from the second fuel supply step (additional fuel supply step) onward. That is, when premixed combustion is adopted, it is possible to properly grasp the gas condition after the first fuel supply step. Thus, it is possible to easily and properly determine the positions of the fuel supply portions 50, the fuel supply amount, etc., with the result that it is possible to realize a reduction in NOx and a reduction in CO.

Further, as stated above, in the present invention, there are executed the first fuel supply step, in which premixed combustion is effected at high air ratio, and the second fuel supply step, in which gas fuel or the like is supplied, thereby making it possible to effectively realize ultra-low NOx and energy saving (a reduction in burner pressure loss and a reduction in $O_2$).

This will be described specifically. In the case, for example, of a boiler which simply performs premixed combustion, neither ultra-low NOx nor energy saving can be realized. Thus, if, in order to perform high air ratio combustion, the supply air amount is increased, "premixed combustion is effected at high air ratio", so it is possible to achieve a reduction in NOx. However, due to the increase in supply air amount, the burner pressure loss increases, so it is necessary to enlarge the capacity of the blower (an increase in power), thus making it impossible to realize energy saving.

According to the present invention, in contrast, the gas fuel supply amount at the time of the first fuel supply step is reduced without involving any increase in supply air amount (or with some increase in supply air amount), making it possible to realize high air ratio premixed combustion at the time of the first fuel supply step. In addition, by using gas fuel in an amount corresponding to the reduction at the time of the first fuel supply step, it is possible to execute the second fuel supply step. That is, according to the present invention, it is possible to realize high air ratio premixed combustion and multi-stage combustion without involving any increase in supply air amount. Thus, as stated above, according to the present invention, there are performed the first fuel supply step, in which premixed combustion is effected at high air ratio, and the second fuel supply step, in which gas fuel or the like is supplied, thereby making it possible to effectively realize ultra-low NOx and energy saving (a reduction in burner pressure loss and a reduction in $O_2$).

The present invention is not restricted to the embodiments and the example described above. Various modifications are possible without departing from the gist of the present invention, and such modifications are all covered by the technical scope of the present invention.

While in the example described above the boiler 1 is a steam boiler, this should not be construed restrictively. The present invention is also applicable to a hot water boiler.

Further, while in the embodiments and the example described above the low-NOx combustion method of the present invention is applied to a boiler, this should not be construed restrictively. Thus, the low-NOx combustion method of the present invention is also applicable to other devices, for example, thermal components, such as a water heater and the reheater of an absorption refrigerator.

Further, while in the above example the fuel supply portions 50 are provided so as to supply fuel from two portions spaced apart from the burner 10 by a predetermined distance in the premixed gas ejecting direction (portions between the water tubes 21A and 21B (see FIG. 2)), this should not be construed restrictively. Thus, for example, it is also possible to shift each of the positions of those two portions (for example, one fuel supply portion may be provided on the further downstream side). Further, it is also possible to provide fuel supply portions so as to supply fuel from three or more portions.

Further, while in the above-described example two-stage combustion is effected (one additional fuel supply step is effected) by using the burner 10 and the fuel supply portions 50 (the pair of fuel ejecting portions 51) provided on the downstream side of the burner 10, this should not be construed restrictively. Thus, for example, it is also possible to provide new fuel supply portions further downstream the fuel supply portions 50 to perform a multi-stage combustion of three or more stages (two or more additional fuel supply steps). In this case, the fuel supply portions from the third stage onward may be "a pair" as shown in FIG. 2 or deviated in position from each other.

Further, while in the above-described example (see FIGS. 1 and 2) and the above-described embodiments the boiler body is a "square type boiler body", this should not be construed restrictively. For example, it is also possible to adopt a "round type boiler body" as shown in FIGS. 3 and 4.

Figure 3:
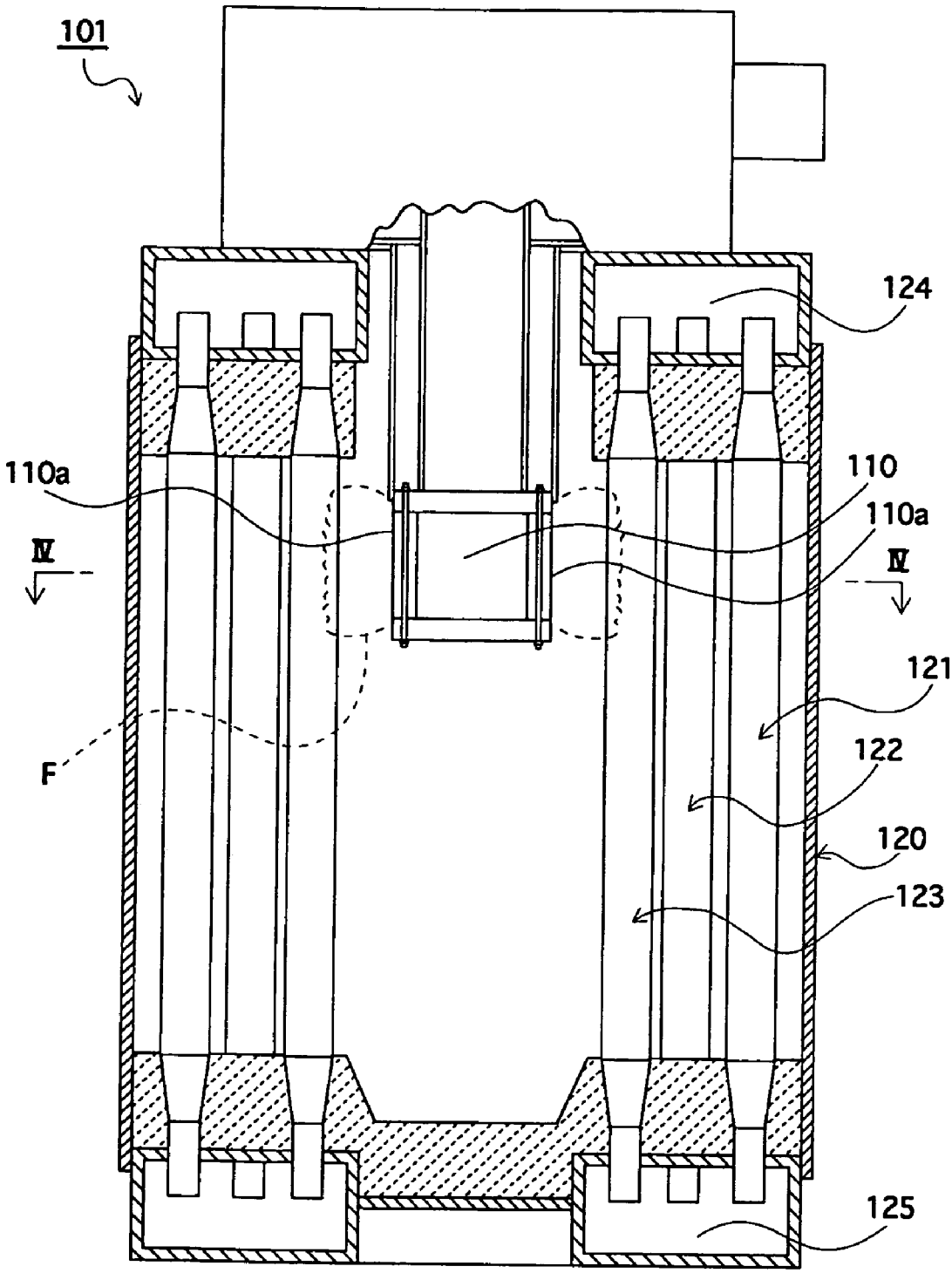
FIG. 3 is an explanatory longitudinal sectional view of another example of a steam boiler according to the present invention.

FIG. 3 is an explanatory longitudinal sectional view of a steam boiler according to another example of the present invention. FIG. 4 is an explanatory cross-sectional view taken along the line IV-IV of FIG. 3.

Figure 4:
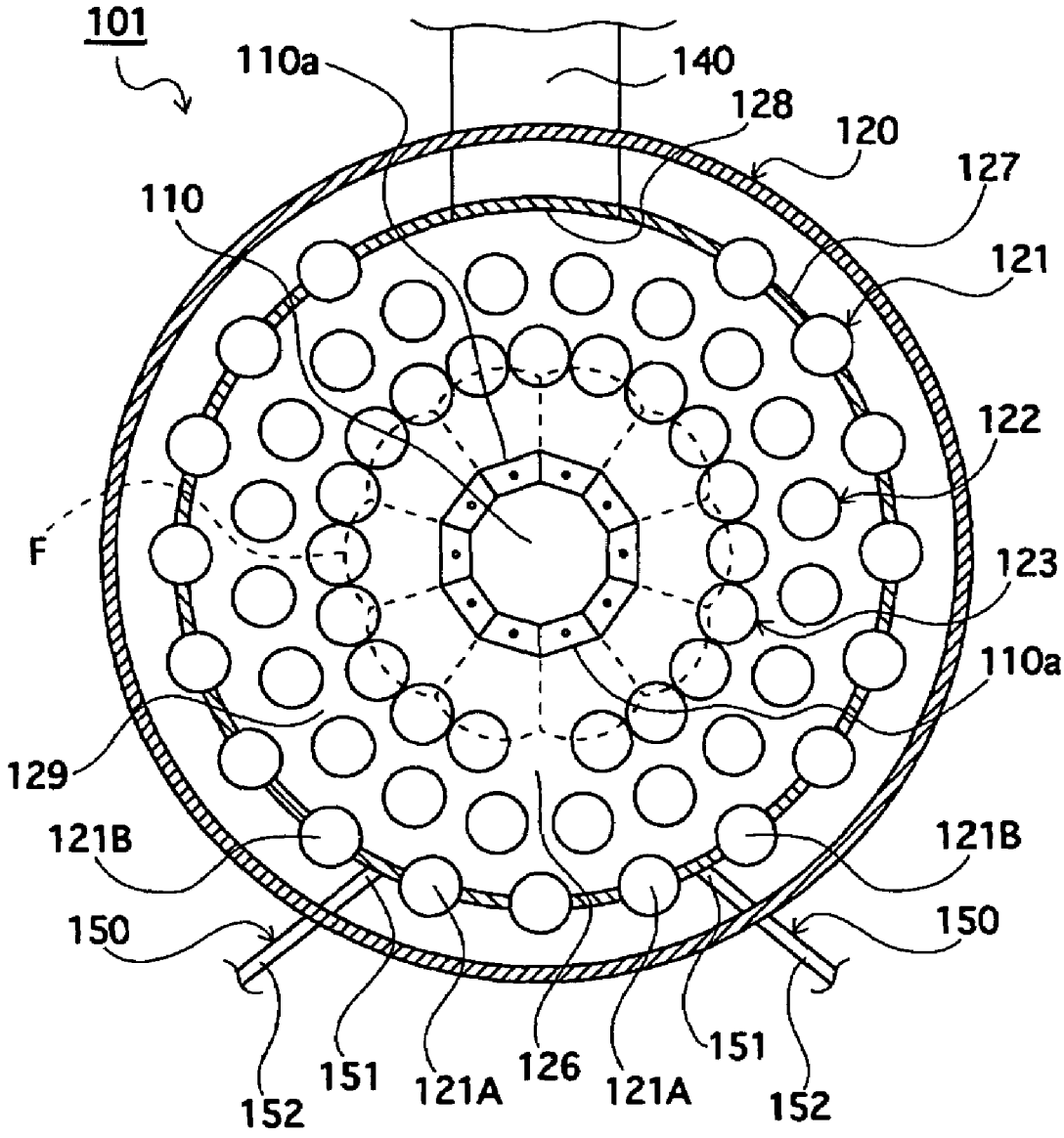
FIG. 4 is an explanatory cross-sectional view taken along a line IV-IV of FIG. 3.

As shown in FIGS. 3 and 4, a boiler 101 according to this example is composed of a completely premixed type burner 110 (corresponding to "the premixed gas burner" of the present invention) having a plurality of flat premixed gas ejection surfaces (combustion surfaces) 110*a*, a boiler body 120 formed by using a large number of water tubes (heat transfer tube group) for heat absorption (an outer water tube group 121, an intermediate water tube group 122, and an inner water tube group 123), a blower (not shown) provided in order to supply combustion air to the burner 110, a chimney portion 140 provided in order to discharge exhaust gas in the boiler body 120 to the exterior of the boiler 101, fuel supply portions 150, etc. The inner water tube group 123 corresponds to the "cooling member" of the present invention.

The boiler body 120 shown in FIGS. 3 and 4 is formed by arranging upright a plurality of water tube groups 121, 122, and 123 between an upper header 124 and a lower header 125. The water tube groups 121, 122, and 123 are formed in substantially concentric annular configurations. The outer water tube group 121 is provided so as to be spaced apart from the inner water tube group 123 by a predetermined distance, with the intermediate water tube group 122 being provided within an annular gas flow passage 129 formed between the inner water tube group 123 and the outer water tube group 121.

In this example, the inner water tube group 123 is basically formed in an annular configuration, with the water tubes thereof being in close contact with each other; and an inner opening 126 is provided in apart thereof. The inner opening 126 functions to guide the gas generated inside the inner water tube group 123 to the annular gas flow passage 129. The intermediate water tube group 122 is formed in an annular configuration, with the water tubes thereof being arranged at substantially equal predetermined intervals. The outer water tube group 121 is formed in an annular configuration, with the water tubes thereof being arranged at substantially equal predetermined intervals; between the water tubes thereof, there are provided fin portions 127 connected together so as to eliminate the gaps between the adjacent water tubes. In a part of the outer water tube group 121, there is provided an outer opening 128, which functions as a discharge portion for discharging to the exterior of the boiler body the gas that has substantially completed combustion reaction. That is, the gas is collected at the outer opening 128, and then discharged to the exterior of the boiler body through a chimney portion 140 provided at a position in the lower portion of the boiler body.

The burner 110 of this example, a detailed description of whose structure is omitted, is formed by stacking together a plurality of plates (uneven or corrugated plates and flat plates or the like), and has a plurality of (ten, in this example) premixed gas ejection surfaces 110*a* each having substantially in the same plane a large number of premixed gas ejection holes through which premixed gas is ejected. In the burner 110, premixed gas is ejected in a radial and planar fashion from the interior of the burner 110 by way of the premixed gas ejection holes formed in the premixed gas ejection surfaces 110*a*. Then, this premixed gas is ignited by an ignition device (not shown), and a gas F is formed by the burner 110.

The premixed gas is ejected from the burner 110 toward the inner water tube group 123 inside the boiler body 120 so as to be substantially perpendicular thereto, so the gas F collides with the inner water tube group 123 inside the boiler body 120, and after the collision, the gas flows axially downwards along the inner peripheral surface of the inner water tube group 123. Then, this gas flows into the annular gas flow passage 129 by way of the inner opening 126, and after flowing through the spaces between the inner water tube group 123, the intermediate water tube group 122, and the outer water tube group 121, is discharged to the exterior of the boiler body 120 by way of the outer opening 128 and the chimney portion 140.

As described above, the boiler 101 of this example is equipped with the boiler body 120 having annularly arranged water tube groups (the outer water tube group 121, the intermediate water tube group 122, and the inner water tube group 123), and the burner 110 arranged at the center of the water tube groups (the inner water tube group 123). In the boiler 101 of this example, there is formed in a part of the inner water tube group 123 a gas flow passage (the inner opening 126) communicating with the inner peripheral surface of the outer water tube group 121; the premixed gas from the burner 110 is ejected toward the inner peripheral surface of the inner water tube group 123 at a predetermined angle, and after a gas flow along the axial direction of the inner water tube group 123 is formed, there is formed, through the gas passage (the inner opening 126), a gas flow along the annular gas flow passage 129 between the inner water tube group 123 and the outer water tube group 121.

The fuel supply portions 150 constituting the boiler 101 of this example is composed of a pair of fuel ejecting portions 151 each formed between two adjacent outer water tubes 121A and 121B, and fuel supply piping 152 for supplying gas fuel to the fuel ejecting portions 151. While in this example gas fuel is ejected from the fuel ejecting portions 151 constituting the fuel supply portions 150, this should not be construed restrictively; it is also possible to eject a premixed gas previously mixed with air from the fuel ejecting portions 151 as needed. While it is omitted here, the fuel supply piping 152 is equipped with a fuel adjustment valve for adjusting the flow rate of the gas fuel (or the premixed gas).

The boiler 101 of this example is constructed as described above. While the structure of the boiler body, the burner structure, etc. thereof differ from those of the above-described example (see FIGS. 1 and 2), it is possible to obtain a boiler capable of realizing a reduction in $O_2$, a reduction in NOx, and a reduction in CO based on an idea similar to that of the above-described example.

That is, as in the above-described example, in the boiler 101 of this example also, the burner 110 is provided in close proximity to the water tubes (the inner water tube group 123), and a multi-stage combustion is realized by the burner 110 and the fuel supply portions 150. Thus, also in the construction of this example, the NOx value at the first stage (the premixed gas burner 110) is reduced as far as possible through gas temperature rise suppression by the water tubes in close proximity thereto and multi-stage combustion, and in order to continuously maintain that NOx value (the low NOx value) to the final stage, the fuel supply portions 150 for the second stage of the multi-stage combustion are provided at appropriate positions, making it possible to realize a reduction in low NOx. That is, as in the above-described boiler 1 shown in FIGS. 1 and 2, the boiler 101 shown in FIGS. 3 and 4 are provided with a first fuel supply step (a main fuel supply step) and a second fuel supply step (an additional fuel supply step), and has a construction capable of realizing a reduction in NOx through gas cooling and fuel supply to a proper gas temperature zone.

While no particular details, such as the air ratio at the premixed gas burner 110 and the gas temperature at the portion where gas fuel or the like is supplied by the fuel supply portions 150, are not given in this example, the values as given in relation to the above-described embodiments, etc. are adopted based on the gist of the present invention.

In this example, the annular gas flow passage 129, the region in the vicinity of the outer opening 128, etc. function as the combustion reaction promoting region. Further, it is also possible to pull out one of the water tubes of the intermediate water tube group 122 provided in the annular gas flow passage 129, and use the resultant space as a combustion promoting region. Further, in order to further promote the combustion reaction, it is also possible to provide a CO oxidation catalytic substance in at least one of the annular gas flow passage 129 and the region in the vicinity of the outer opening 128.

What is claimed is:

1. A boiler comprising:

a premixing portion including a first fuel supply portion that supplies fuel gas to the premixing portion to be mixed with air to form a first premixed gas;

a premixed gas burner that receives the first premixed gas from the premixing portion and ejects the first premixed gas into a boiler chamber where it is subject to a combustion reaction, the boiler chamber having water tubes at a predetermined angle and in close proximity to the premixed gas burner; and a second fuel supply portion that supplies at least one of fuel gas and premixed gas into the boiler chamber at a position spaced apart by a predetermined distance from the premixed gas burner where it is also subject to a combustion reaction, wherein the premixed gas ejected from the premixed gas burner has an air ratio which satisfies the following relational expression:

$$1.3 \leqq \text{air ratio} \leqq 2.0.$$

2. The boiler according to claim 1 further comprising a combustion reaction promoting region for promoting combustion reaction provided on the downstream side of the second fuel supply portion.

3. The boiler according to claim 1, wherein the second fuel supply portion supplies at least one of a gas fuel and a premixed gas to a portion where the gas temperature is within a range as expressed by the following relational expression:

$$800^\circ\text{ C.} \leqq \text{gas temperature} \leqq 1200^\circ\text{ C.}$$

4. The boiler according to claim 1, wherein the fuel gas supplied to the premixing portion corresponds to 80% of an amount of fuel gas that undergoes combustion in the boiler chamber.

5. The boiler according to claim 1 further comprising a chimney portion that gathers exhaust gas from gas combustion in the boiler chamber and expels all of the collected exhaust gas to an area outside of the boiler.

6. A low-$NO_x$ combustion method for reducing $NO_x$ production in a boiler comprising:

supplying air into a premixing portion of the boiler;

supplying fuel gas to the premixing portion of the boiler to premix the air and the first fuel gas to form a first premixed gas;

supplying the first premixed gas from the premixing portion of the boiler to a premixed gas burner;

ejecting and combusting the first premixed gas from the premixed gas burner into a chamber of the boiler containing cooling members; and supplying and combusting at least one of a fuel gas and a further premixed gas in the chamber of the boiler at a position spaced apart by a predetermined distance from the premixed gas burner, wherein, in the first fuel supply step, the premixed gas has air ratio which satisfies a relationship as expressed by the following relational expression:

$$1.3 \leqq \text{air ratio} \leqq 2.0.$$

7. The low-$NO_x$ combustion method according to claim 6 further comprising a combustion reaction promoting step for promoting combustion reaction performed after the second fuel supply step.

8. The low $NO_x$ combustion method according to claim 6, wherein, in the second fuel supply step, the at least one of the gas fuel and the premixed gas is supplied to a portion wherein the gas temperature is within a range as expressed by the following relational expression:

$$800^\circ\ \text{C.} \leqq \text{gas temperature}\ 1200^\circ\ \text{C.}$$

9. The low $NO_x$ combustion method according to claim 6, wherein the fuel gas supplied to the premixing portion of the boiler corresponds to 80% of an amount of fuel gas that undergoes combustion in the chamber of the boiler.

10. The low $NO_x$ combustion method according to claim 6, further comprising using a chimney portion to gather exhaust gas from gas combustion in the boiler chamber and expelling all of the collected exhaust gas to an area outside of the boiler.

* * * * *